US011682510B2

(12) United States Patent
Kanada et al.

(10) Patent No.: US 11,682,510 B2
(45) Date of Patent: Jun. 20, 2023

(54) COMPOSITE MAGNETIC MATERIAL, MAGNETIC CORE, AND ELECTRONIC COMPONENT

(71) Applicant: TDK Corporation, Tokyo (JP)

(72) Inventors: Isao Kanada, Tokyo (JP); Yu Yonezawa, Tokyo (JP)

(73) Assignee: TDK CORPORATION, Tokyo (JP)

( * ) Notice: Subject to any disclaimer, the term of this patent is extended or adjusted under 35 U.S.C. 154(b) by 116 days.

(21) Appl. No.: 16/792,956

(22) Filed: Feb. 18, 2020

(65) Prior Publication Data

US 2020/0273610 A1 Aug. 27, 2020

(30) Foreign Application Priority Data

Feb. 21, 2019 (JP) ..... JP2019-029552
Dec. 25, 2019 (JP) ..... JP2019-234932

(51) Int. Cl.

| | |
|---|---|
| ***H01F 1/24*** | (2006.01) |
| ***H01F 1/33*** | (2006.01) |
| ***H01F 3/08*** | (2006.01) |
| ***H01F 1/20*** | (2006.01) |
| ***H01F 1/12*** | (2006.01) |

(Continued)

(52) U.S. Cl.

CPC ..... *H01F 1/24* (2013.01); *H01F 1/12* (2013.01); *H01F 1/20* (2013.01); *H01F 1/33* (2013.01); *H01F 3/08* (2013.01); *H01F 1/22* (2013.01); *H01F 1/26* (2013.01); *H01F 1/442* (2013.01); *H01F 17/0013* (2013.01); *H01F 2017/048* (2013.01)

(58) Field of Classification Search

CPC ... H01F 1/24; H01F 1/33; H01F 1/442; H01F 3/08; H01F 17/0013; H01F 2017/048; H01F 1/26; H01F 1/20; H01F 1/12; H01F 1/22

See application file for complete search history.

(56) References Cited

U.S. PATENT DOCUMENTS

2002/0097124 A1* 7/2002 Inoue ..... H01F 27/027 336/83
2004/0079449 A1* 4/2004 Kanekiyo ..... H01F 1/0578 148/302

(Continued)

FOREIGN PATENT DOCUMENTS

EP 1085506 A1 * 3/2001 ..... B22F 1/004
JP H11-260617 A 9/1999
JP 2002-105502 A 4/2002

*Primary Examiner* — Keith Walker
*Assistant Examiner* — Adil A. Siddiqui
(74) *Attorney, Agent, or Firm* — Oliff PLC

(57) ABSTRACT

A composite magnetic material includes a powder and a resin. The powder has a main component containing Fe or Fe and Co. An average minor axis length in primary particles of the powder is 100 nm or less. A point satisfying (X, Y)=($\sigma/A_v$ (%), ($A_v$-$\sigma$)) on an XY coordinate plane is present within a region (including a boundary) surrounded by three points α(24.5, 6.7), β(72.0, 1.2), and γ(24.5, 1.2), in which an average of aspect ratios in the primary particles of the powder is set to $A_v$, and a standard deviation of the aspect ratios in the primary particles of the powder is set to σ.

13 Claims, 3 Drawing Sheets

(51) Int. Cl.

| | |
|---|---|
| ***H01F 1/44*** | (2006.01) |
| ***H01F 1/26*** | (2006.01) |
| ***H01F 17/00*** | (2006.01) |
| ***H01F 17/04*** | (2006.01) |
| ***H01F 1/22*** | (2006.01) |

(56) References Cited

U.S. PATENT DOCUMENTS

| | | | | |
|---|---|---|---|---|
| 2007/0252771 | A1* | 11/2007 | Maezawa | H05K 9/0083 343/841 |
| 2010/0060538 | A1* | 3/2010 | Suetsuna | H01Q 9/42 343/787 |
| 2014/0158929 | A1* | 6/2014 | Oikawa | H01F 1/26 252/62.54 |

* cited by examiner

COMPOSITE MAGNETIC MATERIAL, MAGNETIC CORE, AND ELECTRONIC COMPONENT

TECHNICAL FIELD

The present invention relates to a composite magnetic material, a magnetic core, and an electronic component.

BACKGROUND

In recent years, a frequency band used by wireless communication devices such as mobile phones and personal digital assistants has been increasing, and a wireless signal frequency used is in a GHz band. Therefore, applying a magnetic material having a relatively large permeability even in a high-frequency range of the GHz band to such electronic components used in the high-frequency range of the GHz band have been attempted to improve a filter characteristic and reduce antenna dimensions of such electronic components. In addition, it is desired to reduce a magnetic loss of such electronic components in the high-frequency range. In this regard, increasing an aspect ratio, etc. of the magnetic material used for the magnetic core have been attempted.

For example, Patent Document 1 discloses a composite material using a FeSiAl based powder and a spherical powder. Patent Document 2 discloses a composite material using an amorphous powder and a spherical powder.

However, at present, a magnetic core having a higher relative permeability μr and a lower magnetic loss tan δ is desired.

[Patent Document 1] JP Patent Application Laid Open. No. 11-260617

[Patent Document 2] JP Patent Application Laid Open. No. 2002-105502

BRIEF SUMMARY OF THE INVENTION

An object of the invention is to provide a composite magnetic material having a high relative permeability μr and a low magnetic loss tan δ in a high-frequency region of a GHz band and having high adhesion and hardly causing cracking or peeling when mounted on a product, and a magnetic core and an electronic component using the composite magnetic material.

In order to achieve the object, the composite magnetic material of the invention is a composite magnetic material including a powder and a resin, in which the powder has a main component containing Fe or Fe and Co, an average minor axis length in primary particles of the powder is 100 nm or less, and a point satisfying (X, Y)=($\sigma/A_v$ (%), ($A_v$-σ)) on an XY coordinate plane is present within a region (including a boundary) surrounded by three points α(24.5, 6.7), β(72.0, 1.2), and γ(24.5, 1.2), in which an average of aspect ratios in the primary particles of the powder is set to $A_v$, and a standard deviation of the aspect ratios in the primary particles of the powder is set to σ.

According to the above-mentioned configuration, the composite magnetic material of the invention becomes a composite magnetic material having a high relative permeability μr and a low magnetic loss tan δ in a high-frequency region of a GHz band and having high adhesion and hardly causing cracking or peeling when mounted on a product.

A content ratio of Co to the main component is preferably 0 to 40 atom % (excluding 0 atom %) in the powder.

A magnetic core of the invention includes the composite magnetic material.

An electronic component of the invention includes the composite magnetic material.

DETAILED DESCRIPTION OF INVENTION

Hereinafter, the invention will be described based on an embodiment illustrated in drawings.

A magnetic core of the present embodiment includes a composite magnetic material containing powder and resin.

Further, the powder includes a soft magnetic material containing Fe or Fe and Co as a main component. An average minor axis length of primary particles of the powder is 100 nm or less. When the average minor axis length is 100 nm or less, a magnetic loss (tan δ) of the magnetic core can be reduced. There is no lower limit on the average minor axis length of the primary particles of the powder. For example, the average minor axis length of the primary particles of the powder may be 15 nm or more.

The magnetic loss of the magnetic core increases when the average minor axis length exceeds 100 nm since a magnetic domain wall which causes the magnetic loss is easily generated in the primary particles, and further, an eddy current loss occurs.

In addition, a shape of the powder is not particularly limited. The shape may correspond to a spherical shape, a needle-like shape, a pseudo-needle-like shape, a spheroidal shape, or a pseudo-spheroidal shape.

The minor axis length, the major axis length, and the aspect ratio in the primary particles of the powder are calculated using the following method.

Figure 1:
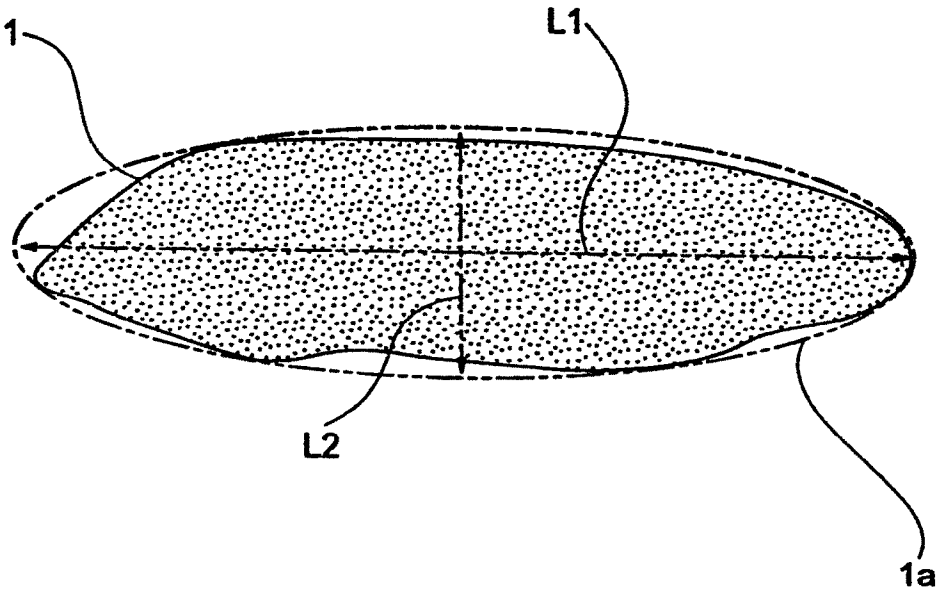
FIG. 1 is a drawing illustrating a major axis length and a minor axis length in a composite magnetic material.

First, powder 1 for measuring the major axis length, the minor axis length and the aspect ratio is photographed as a two-dimensional (2D) image at a magnification of 100,000 or more using a TEM. On the photographed 2D image, as illustrated in FIG. 1, an ellipse 1*a* circumscribing powder 1 is drawn, a length of a major axis L1 of the ellipse 1*a* is defined as the major axis length, and a length of a minor axis L2 is defined as the minor axis length. Then, the aspect ratio is set to L1/L2.

In the composite magnetic material according to the present embodiment, a point satisfying (X, Y)=($\sigma/A_v$ (%), ($A_v$-σ)) on the XY coordinate plane is present within a region (including a boundary) surrounded by three points α(24.5, 6.7), β(72.0, 1.2), and γ(24.5, 1.2), in which an average of the aspect ratios in the primary particles of the powder is set to $A_v$, and a standard deviation of the aspect ratios in the primary particles of the powder is set to σ.

In addition, the powder contains Fe or Fe and Co as a main component. Here, containing as a main component means that the content ratio of Fe or Fe and Co to the whole powder is 50 atom % or more.

Further, the Co content with respect to the total content of the main components Fe and Co is preferably 0 to 40 atom % (excluding 0 atom %), and more preferably 20 to 40 atom %. When the powder contains Fe and Co as main components, the effect of increasing the relative permeability μr is further increased.

In addition, the powder may contain elements other than the main components, for example, V, Cr, Mn, Cu, Zn, Ni, Mg, Ca, Sr, Ba, rare earth elements, Ti, Zr, Hf, Nb, Ta, Zn, Al, Ga, Si, etc. In particular, the powder may contain Al, Si and/or Ni to improve oxidation resistance. The total content of other elements is not limited, and is preferably 5% by mass or less with respect to the whole powder.

In addition, the powder may be coated with an oxide layer. A type of oxide contained in the oxide layer and a thickness of the oxide layer are not limited. For example, it is possible to adopt an oxide containing one or more nonmagnetic metals selected from Mg, Ca, Sr, Ba, rare earth elements, Ti, Zr, Hf, Nb, Ta, Zn, Al, Ga and Si. The thickness of the oxide layer may be set to, for example, 1.0 nm or more and 10.0 nm or less, or may be set to 1.0 nm or more and 5.0 nm or less. By coating the powder with the oxide layer, oxidation of the powder can be easily prevented.

The powder is further coated with a resin. That is, the composite magnetic material according to the present embodiment has a resin. A type of resin is not limited. Examples thereof include epoxy resin, phenol resin, and acrylic resin. By being coating with a resin, an insulating property is improved, generation of an eddy current between powders for suppressing magnetization rotation described later can be suppressed, and the relative permeability μr can be greatly improved.

High average $A_v$ of the aspect ratios in the primary particles of the powder tends to reduce the magnetic loss tan δ, particularly tan δ at a high frequency. In addition, low above-mentioned σ tends to reduce the magnetic loss tan δ. That is, $\sigma/A_v$ (%) is a parameter indicating a variation in the aspect ratios of the primary particles, and $A_v$-σ is a parameter combining portions of shapes of the primary particles greatly affecting the magnetic loss tan δ. When a relationship between $\sigma/A_v$ (%) and ($A_v$-σ) is in a specific range, a magnetic core having high relative permeability μr and low magnetic loss tan δ in the high-frequency range of the GHz band, having high adhesion when mounted on a product, having small hardening shrinkage, and hardly causing cracking and peeling is obtained. Specifically, an excellent property is obtained when a point satisfying (X, Y)=($\sigma/A_v$ (%), ($A_v$-σ)) is present within a region (including a boundary) surrounded by three points α(24.5, 6.7),β(72.0, 1.2), and γ(24.5, 1.2).

A reason for obtaining the excellent property in the above case is considered to be as follows.

It is considered that the magnitude of magnetization developed in the composite magnetic material in the high-frequency range strongly depends on the displacement magnitude of precession of magnetization inside the powder of the composite magnetic material. As the displacement magnitude of the precession increases, the magnetization developed in the composite magnetic material increases, and a high permeability is obtained.

Here, in a case where the composite magnetic material contains powder having large shape anisotropy, that is, powder having a large aspect ratio, a single magnetic domain structure in the powder is easily self-organized by a demagnetizing field when an external magnetic field is applied to the composite magnetic material.

As a result, when the composite magnetic material contains the powder having the large aspect ratio, precession of magnetization is suppressed, and the relative permeability μr tends to decrease. However, since the self-organization of the single magnetic domain structure tends to occur and the magnetization structure inside the powder is uniform, the effective magnetization of the composite magnetic material tends to increase, and a frequency property of the composite magnetic material tends to increase in frequency.

On the other hand, when the composite magnetic material contains powder having a small aspect ratio, precession of magnetization is promoted, and the relative permeability μr tends to increase. However, since a self-organizing force of the single magnetic domain structure is weak and the magnetization is easily disturbed, the effective magnetization of the composite magnetic material is easily reduced, and the frequency property tends to decrease in frequency.

Here, when the composite magnetic material includes powder having a large variation in the aspect ratio, that is, when powder having large $\sigma/A_v$ is included, powder having a large aspect ratio is preferentially self-organized. In this instance, an exchange interaction occurs between powders, and powder having a small aspect ratio tends to self-organize in the same direction as that of powder having a large aspect ratio. Therefore, an internal structure of powder having a small aspect ratio is uniformed from self-organization of powder having a large aspect ratio, and the effective magnetization increases. Then, the frequency property of the composite magnetic material increases in frequency.

Conversely, powder having a small aspect ratio has large magnetization precession. In this instance, an exchange interaction occurs between powders, and precession of powder having a large aspect ratio tends to increase. Therefore, precession of powder having a large aspect ratio becomes large from precession of powder having a small aspect ratio. Then, the relative permeability μr of the composite magnetic material increases.

Here, increasing $A_v$ of powder tends to decrease μr of the composite magnetic material containing the powder and tan δ. Further, increasing $A_v$ of powder tends to decrease the density of the composite magnetic material or the magnetic core containing the powder and the relative permeability μr of the composite magnetic material containing the powder. In addition, increasing a of the powder tends to increase tan& Therefore, when the relationship between $\sigma/A_v$ and ($A_v$-σ) of the powder is within a specific range, it becomes easy to achieve both high relative permeability μr and low tan δ. Specifically, when a point satisfying (X, Y)=($\sigma/A_v$ (%), ($A_v$-σ)) is present within a region (including a boundary) surrounded by three points α(24.5, 6.7),β(72.0, 1.2), and γ(24.5, 1.2), an excellent magnetic property and excellent adhesion to the product when mounted on the product are obtained. To obtain high relative permeability μr, $A_v$-σ is preferably 6.0 or less. In addition, as $\sigma/A_v$ of the powder decreases, a particle filling property decreases, and thus voids are easily generated in the composite magnetic material. For this reason, adhesion of the composite magnetic material to the product deteriorates, and peeling easily occurs. On the other hand, when ($A_v$-σ) of the powder is fixed, the particle filling property is improved as $\sigma/A_v$ of the powder increases. For this reason, voids are rarely generated in the composite magnetic material, and the adhesion is excellent. However, as $\sigma/A_v$ of the powder increases, hardening shrinkage of resin increases. For this reason, a large stress is applied to the composite magnetic material, and cracking easily occurs.

It is sufficient that the magnetic core according to the present embodiment includes the above-described composite magnetic material. In addition, a type of the magnetic core is not particularly limited. For example, a dust magnetic core may be used. In addition, for example, a dust magnetic core in which a coil is embedded may include the above-described composite magnetic material.

In addition, a content ratio of the powder (hereinafter, also referred to as a volume occupation) to the entire magnetic core is preferably set to 25 vol % or more. When the volume occupation is set to be sufficiently high, the relative permeability μr can be sufficiently improved.

Here, a method of calculating the volume occupation is not particularly limited. For example, the following method can be used.

First, a cross section obtained by cutting the magnetic core is polished to fabricate an observation surface. Subsequently, the observation surface is observed using an electron microscope (SEM). In this instance, an observed image may be binarized by removing noise. Then, an area ratio of the powder to the area of the entire observation surface is calculated. In the present embodiment, the area ratio and the volume occupation are regarded as equal, and the area ratio is set as the volume occupation.

In addition, in calculating the volume occupation, the observation surface has a size including a total of 1,000 particles or more of the powder. Note that observation surfaces may be used and have sizes including 1,000 particles or more in total.

Hereinafter, a method of manufacturing the composite magnetic material, the magnetic core, and the electronic component according to the present embodiment will be described. However, the method of manufacturing the composite magnetic material, the magnetic core, and the electronic component according to the present embodiment is not limited to the following method.

First, powder containing a soft magnetic material whose main component is Fe or Fe and Co is produced. Here, for example, by preparing and mixing types of powders having different average aspect ratios of primary particles from each other, $\sigma/A_v$ can be easily increased to 24.5% or more, and the relationship between $\sigma/A_v$ and $(A_v-\sigma)$ is easily set within a specific range in the finally obtained composite magnetic material. On the other hand, when one type of powder is used, $\sigma/A_v$ does not normally become 24.5% or more. When there is an attempt to set $\sigma/A_v$ to 24.5% or more using one type of powder, it is necessary to intentionally prepare powder having a large variation in the aspect ratios of the primary particles. A method of producing the powder is not particularly limited, and a normal method in this technical field can be used. For example, the powder may be produced by a known method of heating and reducing a raw material powder containing a compound such as α-FeOOH, FeO or CoO. By controlling the content of Fe, Co and/or other elements in the raw material powder, a composition of the obtained powder can be controlled.

Here, by controlling an average minor axis length and an average aspect ratio of the raw material powder, it is possible to control the average minor axis length, the average major axis length, and the average aspect ratio of the powder. A method of controlling the average minor axis length, the average major axis length, and the average aspect ratio of the powder is not limited to the above method.

In addition, as a case where the powder is coated with the oxide layer of the nonmagnetic metal, a method of performing heat reduction after adding nonmagnetic metal to the raw material powder is exemplified. The method of adding the nonmagnetic metal to the raw material powder is not particularly limited. For example, there is a method in which the raw material powder and a solution containing a nonmetallic element are mixed, the pH is adjusted, and the mixture is filtered and dried. In addition, the thickness of the oxide layer can be controlled by controlling the concentration, the pH, a mixing time, etc. of the solution containing the nonmetallic element.

The powder can be coated with the resin by mixing the powder obtained by heat reduction according to the above method with the resin. A method of coating with the resin is not limited. For example, coating with the resin can be performed by adding a solution containing 20 to 60 vol % of resin to 100 vol % of powder, and mixing and then drying the solution and the powder.

Then, the composite magnetic material according to the present embodiment can be obtained by appropriately controlling the aspect ratio of the powder and the variation in the aspect ratios.

A method of producing the magnetic core from the above-described composite magnetic material is not limited. A normal method according to the present embodiment can be used.

For example, there is a method of producing the magnetic core by kneading the above-described composite magnetic material, cooling and pulverizing the composite magnetic material to obtain powder, filling a press mold with the obtained powder to perform press-molding, and performing a thermosetting treatment. Alternatively, the magnetic core may be produced using another method.

The use of the composite magnetic material and the magnetic core according to the present embodiment is not particularly limited. The use includes electronic components, for example, coil components, inductor components, LC filters, antennas, etc. A method of manufacturing the electronic component including the composite magnetic material according to the present embodiment is not particularly limited, and a normal method according to the present embodiment can be used.

EXAMPLES

Next, the invention will be described in more detail based on specific examples. However, the invention is not limited to the following examples.

First, powder was produced. The powder was produced by a known method of heat-reducing powder containing α-FeOOH in $H_2$ atmosphere.

In this instance, powders containing α-FeOOH having different average aspect ratios each other were prepared. Powders having minor axis lengths, major axis lengths and average aspect ratios described in each table were obtained by controlling the minor axis lengths, the major axis lengths and the average aspect ratios of the powders containing α-FeOOH at this time.

Further, by controlling the content of Co in the powders containing α-FeOOH, compositions of the powders were controlled to compositions shown in each table. The compositions shown in each Table correspond to atomic ratios.

Resin was added to the powder obtained by the above method. Further, powder 1 and powder 2 shown in Table 1 were mixed at a volume ratio shown in each Table. Using a mixing roll, kneading was performed at 95° C., kneading was continued while gradually performing cooling to 70° C., kneading was stopped and rapid cooling was performing to room temperature at 70° C. or less, thereby obtaining the composite magnetic material. In an experimental example in which a column for powder 1 is blank, the resin was added to only powder 2 and kneaded. In addition, JER806: Mitsubishi Chemical Corporation which is an epoxy resin was used as the resin.

Subsequently, the obtained composite magnetic material was filled into a press mold heated to 100° C., and molded at a molding pressure of 980 MPa. The obtained formed body was thermally hardened at 180° C. and then cut out to obtain samples for measurement of μr and tan δ in respective examples and comparative examples shown in each Table. A shape of the sample was set to a rectangular parallelepiped of 1 mm×1 mm×100 mm.

When the frequency was set to 1.0 GHz and when the frequency was set to 3.5 GHz, the relative permeability μr and the magnetic loss tan δ of the examples and the comparative examples were measured. The relative permeability μr and the magnetic loss tan δ were measured by a perturbation method using a network analyzer (HP8753D, manufactured by Agilent Technologies Japan, Ltd.) and a cavity resonator (manufactured by Kanto Electronics Application Development Inc.). Table 2 shows results. Note that the magnetic loss tan δ of 0.005 or less was determined to be excellent when the frequency is 1.0 GHz. In the case of the frequency of 3.5 GHz, 0.015 or less was determined to be excellent, and 0.010 or less was determined to be further excellent. In the case of the frequency of 1.0 GHz, the relative permeability μr of 1.50 or more was determined to be excellent. In the case of the frequency of 3.5 GHz, 1.60 or more was determined to be excellent, and 1.70 or more was determined to be further excellent.

Figure 2:
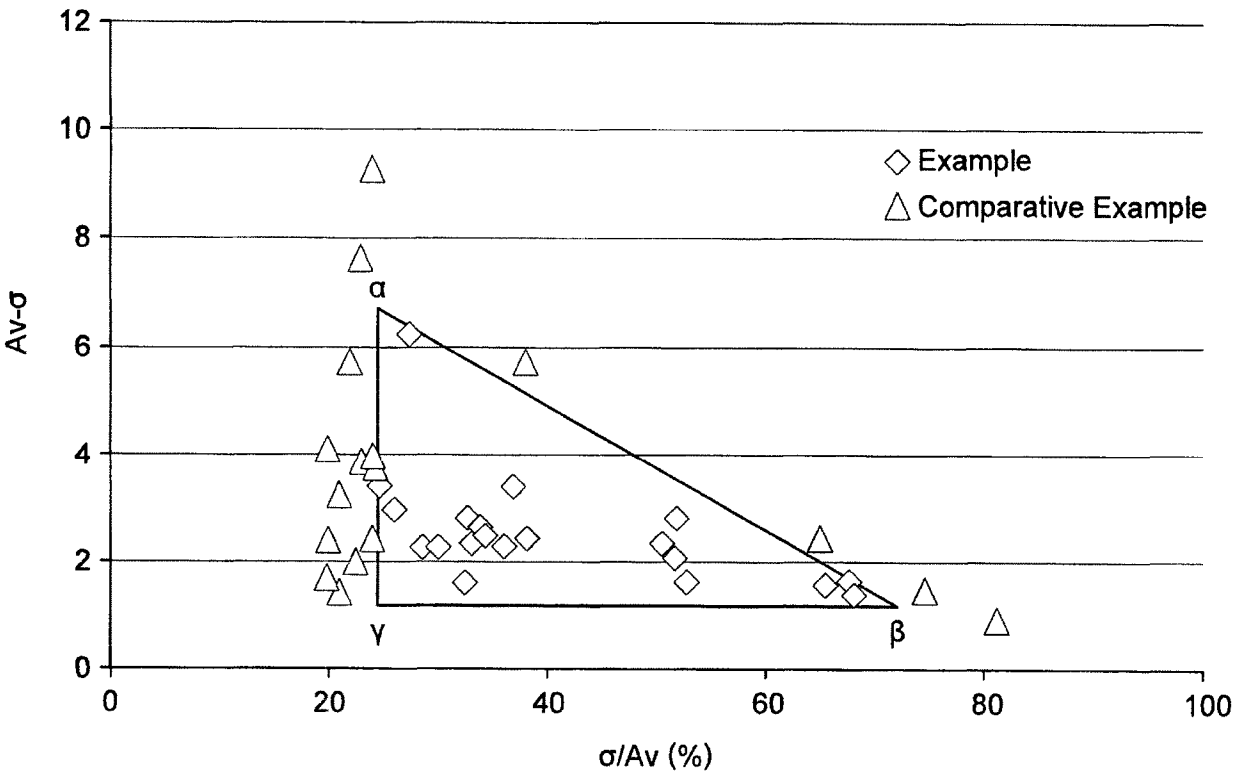
FIG. 2 is a graph in which examples and comparative examples are plotted on an XY coordinate plane.

Further, 500 aspect ratios of the primary particles of the powder contained in the obtained magnetic core were measured, and an average aspect ratio $A_v$ and a standard deviation σ were calculated. Then, $\sigma/A_v$ (%) and $A_v$-σ were calculated. Table 2 shows results. Note that for examples and comparative examples having an average minor axis length of 100 nm or less, a point represented by (X, Y)=($\sigma/A_v$ (%), ($A_v$-σ)) was plotted on the XY coordinate plane. FIG. 2 shows results.

Each of the examples and the comparative examples was subjected to an adhesion test with an alumina substrate assuming mounting on a product. The composite magnetic material after kneading and cooling was filled into a press mold heated to 100° C. and pressed at a molding pressure of 500 MPa to form a plate containing a composite material having a diameter of 10 mm and a thickness of about 1.0 mm. An alumina plate was prepared separately from the above plate. Specifically, an alumina plate having a diameter of 10 mm and a thickness of 2 mm in which a cylindrical pit having a diameter of 0.5 mm and a depth of 0.25 mm were formed on one surface was prepared. Vacuum packing was performed so that a surface of the composite magnetic material plate having a diameter of 10 mm was in contact with a surface of the alumina plate on which the pit was formed. Then, the pit was filled with the composite magnetic material by molding at a temperature of 80° C. and a hydrostatic pressure of 196 MPa. The composite magnetic material plate and the alumina plate were subjected to a thermosetting treatment at 180° C., and then filled with resin and polished, thereby exposing a cross section in a thickness direction of a pit portion. The presence or absence of peeling at an interface between the alumina plate and the composite magnetic material in the cross section and the presence or absence of cracking in the composite magnetic material were observed. Table 2 shows results. When neither peeling nor cracking occurred, a result of the adhesion test was determined to be excellent. For comparative examples, in which either μr or tan δ was poor, except for Comparative Example 13, the above-mentioned adhesion test was not performed.

Figure 3:
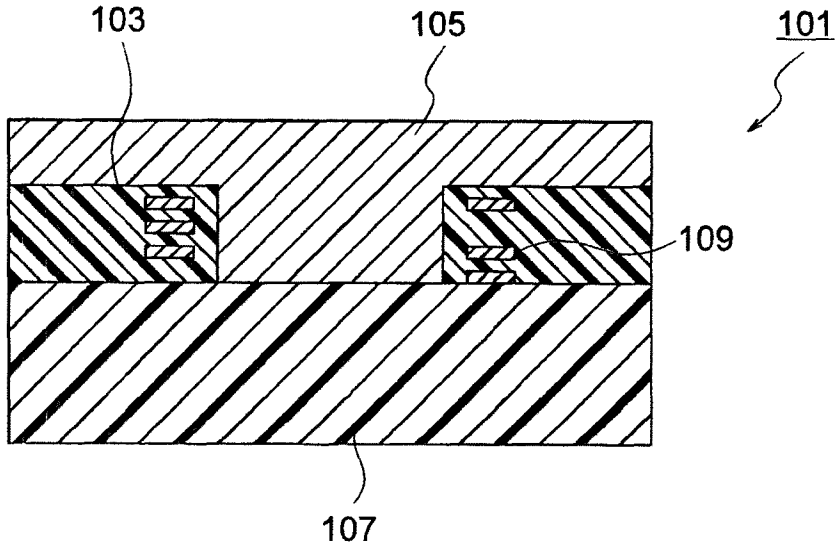
FIG. 3 is a cross-sectional view of an inductor component including a composite magnetic body.

Further, an inductor component 101 illustrated in FIG. 3 was actually produced using the composite magnetic materials of the respective examples and comparative examples. Hereinafter, a method of manufacturing the inductor component 101 will be described.

First, a substrate 107 corresponding to a high-resistance Si substrate having a thickness of 100 μm was prepared. Subsequently, coils were formed on the substrate 107 by a known method using photolithography and plating. As illustrated in FIG. 3, a structure was formed such that a coil conductor 109 was covered with a resin 103 including a UV curable resin (polyimide). An outer diameter of the coil was set to 230 μm, an inner diameter of the coil was set to 170 μm, the number of turns was set to 3, and a thickness of the resin 103 was set to 60 μm. A material of the coil conductor 109 was set to copper. Subsequently, the resin 103 inside the coil was removed to form a space having a diameter of 140 μm and a depth of 60 μm. Subsequently, the composite magnetic material of each of the examples and comparative examples was thinly spread to about 0.5 to 1 mm, placed on the resin 103, and pressurized at 90° C. in a vacuum, thereby filling an inside of the coil and a top of the coil with the composite magnetic material. Subsequently, a hardening treatment of the composite magnetic material was performed at 180° C. for 3 hours. In some comparative examples, cracking or peelings occurred during the hardening treatment. The top of the coil was flattened with a grinder to remove excess composite magnetic material, thereby forming a composite magnetic body 105. A thickness of the composite magnetic body 105 was set to 40 μm from above the resin 103 and 100 μm from above the substrate 107. Subsequently, inductor components 101 were cut out from the substrate 107 using a dicing saw.

Each of the inductor components 101 was soldered to an evaluation board of a network analyzer (HP8753D, manufactured by Agilent Technologies Japan, Ltd.), and L and Q at a frequency of 3.5 GHz were measured. A case where L was 3.5 nH or more was regarded as excellent. A case where Q was 18.0 or more was regarded as excellent.

With regard to cracking and peeling, first, ten inductor components 101 were taken out for each of the examples and comparative examples. Then, a cross section in a longitudinal direction passing through a center of the coil was observed using an optical microscope. Then, the number of cracked inductor components 101 and the number of peeled inductor components 101 were counted. Table 2 shows results. A case where a ratio of the cracked inductor components 101 and a ratio of the peeled inductor components 101 are less than 1% is regarded as excellent. That is, in this experimental example, a case where the cracked inductor component 101 was not observed was regarded as excellent, and a case where the peeled inductor component 101 was not observed was regarded as excellent. Note that cracks in the inductor component 101 mainly occur from an edge of the space having the diameter of 140 μm and the depth of 60 μm toward the inside of the composite magnetic body 105. In addition, peeling of the inductor component 101 mainly occurs at a boundary between the substrate 107 and the composite magnetic body 105.

TABLE 1

| | Powder 1 | | | Powder 2 | | | Powder 1: | |
|---|---|---|---|---|---|---|---|---|
| | Com-position | Average minor axis length (nm) | Aveage aspect ratio | Com-position | Average minor axis length (nm) | Aveage aspect ratio | Powder 2 (Volume ratio) | volume occupation (vol %) |
| Comparative Example 1 | — | — | — | Fe100 | 21 | 3.0 | 0:100 | 40 |
| Comparative Example 2 | — | — | — | Fe100 | 24 | 5.0 | 0:100 | 40 |
| Example 1 | Fe100 | 24 | 5.0 | Fe100 | 21 | 3.0 | 50:50 | 40 |
| Comparative Example 3 | — | — | — | Fe85Co15 | 21 | 1.8 | 0:100 | 40 |
| Comparative Example 4 | — | — | — | Fe85Co15 | 23 | 3.0 | 0:100 | 40 |
| Comparative Example 5 | — | — | — | Fe75Co25 | 19 | 4.1 | 0:100 | 39 |
| Comparative Example 6 | — | — | — | Fe75Co25 | 18 | 5.1 | 0:100 | 37 |
| Comparative Example 7 | — | — | — | Fe75Co25 | 22 | 7.3 | 0:100 | 35 |
| Comparative Example 8 | — | — | — | Fe75Co25 | 22 | 9.9 | 0:100 | 32 |
| Comparative Example 9 | — | — | — | Fe75Co25 | 21 | 12.2 | 0:100 | 30 |
| Example 3 | Fe85Co15 | 23 | 3.0 | Fe85Co15 | 21 | 1.8 | 30:70 | 41 |
| Example 4 | Fe75Co25 | 18 | 5.1 | Fe85Co15 | 21 | 1.8 | 40:60 | 44 |
| Example 5 | Fe75Co25 | 22 | 7.3 | Fe85Co15 | 21 | 1.8 | 40:60 | 47 |
| Comparative Example 10 | Fe75Co25 | 22 | 9.9 | Fe85Co15 | 21 | 1.8 | 40:60 | 45 |
| Example 8 | Fe75Co25 | 19 | 4.1 | Fe85Co15 | 23 | 3.0 | 40:55 | 40 |
| Example 9 | Fe75Co25 | 19 | 4.1 | Fe85Co15 | 23 | 3.0 | 40:60 | 40 |
| Example 10 | Fe75Co25 | 18 | 5.1 | Fe85Co15 | 23 | 3.0 | 10:90 | 42 |
| Example 11 | Fe75Co25 | 18 | 5.1 | Fe85Co15 | 23 | 3.0 | 25:75 | 44 |
| Example 12 | Fe75Co25 | 18 | 5.1 | Fe85Co15 | 23 | 3.0 | 40:60 | 44 |
| Example 13 | Fe75Co25 | 18 | 5.1 | Fe85Co15 | 23 | 3.0 | 40:60 | 40 |
| Example 14 | Fe75Co25 | 18 | 5.1 | Fe85Co15 | 23 | 3.0 | 60:40 | 41 |
| Example 15 | Fe75Co25 | 22 | 7.3 | Fe85Co15 | 23 | 3.0 | 40:60 | 44 |
| Example 16 | Fe75Co25 | 22 | 7.3 | Fe85Co15 | 23 | 3.0 | 30:70 | 44 |
| Example 17 | Fe75Co25 | 22 | 9.9 | Fe85Co15 | 23 | 3.0 | 30:70 | 46 |
| Example 18 | Fe75Co25 | 22 | 9.9 | Fe85Co15 | 23 | 3.0 | 20:80 | 46 |
| Comparative Example 11 | Fe75Co25 | 21 | 12.2 | Fe85Co15 | 23 | 3.0 | 20:80 | 46 |
| Example 19 | Fe75Co25 | 18 | 5.1 | Fe75Co25 | 19 | 4.1 | 40:60 | 39 |
| Example 20 | Fe75Co25 | 22 | 7.3 | Fe75Co25 | 19 | 4.1 | 35:65 | 41 |
| Example 21 | Fe75Co25 | 22 | 9.9 | Fe75Co25 | 19 | 4.1 | 30:70 | 41 |
| Comparative Example 12 | Fe75Co25 | 21 | 12.2 | Fe75Co25 | 19 | 4.1 | 30:70 | 39 |
| Example 22 | Fe75Co25 | 22 | 9.9 | Fe75Co25 | 22 | 7.3 | 50:50 | 40 |
| Comparative Example 13 | Fe75Co25 | 21 | 12.2 | Fe75Co25 | 22 | 7.3 | 30:70 | 38 |
| Comparative Example 14 | — | — | — | Fe90Co10 | 90 | 3.2 | 0:100 | 40 |
| Comparative Example 15 | — | — | — | Fe90Co10 | 98 | 5.2 | 0:100 | 40 |
| Comparative Example 16 | — | — | — | Fe85Co15 | 110 | 3.0 | 0:100 | 39 |
| Comparative Example 17 | — | — | — | Fe85Co15 | 106 | 5.3 | 0:100 | 39 |
| Example 23 | Fe90Co10 | 98 | 5.2 | Fe90Co10 | 90 | 3.2 | 50:50 | 42 |
| Comparative Example 18 | Fe85Co15 | 106 | 5.3 | Fe85Co15 | 110 | 3.0 | 50:50 | 42 |
| Comparative Example 19 | — | — | — | Fe75Co25 | 63 | 2.1 | 0:100 | 40 |
| Comparative Example 20 | — | — | — | Fe75Co25 | 61 | 4.9 | 0:100 | 40 |
| Example 24 | Fe75Co25 | 61 | 4.9 | Fe75Co25 | 63 | 2.1 | 50:50 | 42 |
| Comparative Example 21 | — | — | — | Fe75Co25 | 40 | 2.5 | 0:100 | 40 |
| Comparative Example 22 | — | — | — | Fe75Co25 | 45 | 5.2 | 0:100 | 41 |
| Example 25 | Fe75Co25 | 45 | 5.2 | Fe75Co25 | 40 | 2.5 | 50:50 | 43 |

TABLE 2

| | | | | 1.0 GHz | | 3.5 GHz | | Inductor 3.5 GHz | | | |
|---|---|---|---|---|---|---|---|---|---|---|---|
| | $A_v$ | $\sigma/A_v$ (%) | $A_v - \sigma$ | Relative permeability μr | Magnetic loss tanδ | Relative permeability μr | Magnetic loss tanδ | L (nH) | Q | Cracking | Peeling |
| Comparative Example 1 | 3.0 | 20.0 | 2.4 | 1.72 | 0.004 | 1.82 | 0.014 | 3.8 | 18.3 | 0 | 3 |
| Comparative Example 2 | 5.0 | 23.0 | 3.9 | 1.60 | 0.003 | 1.69 | 0.011 | 3.8 | 18.3 | 0 | 4 |
| Example 1 | 4.0 | 33.9 | 2.6 | 1.73 | 0.004 | 1.84 | 0.014 | 3.8 | 18.3 | 0 | 0 |
| Comparative Example 3 | 1.8 | 21.0 | 1.4 | 2.30 | 0.004 | 2.45 | 0.016 | 4.0 | 18.3 | 0 | 3 |
| Comparative Example 4 | 3.0 | 20.0 | 2.4 | 1.82 | 0.003 | 1.94 | 0.009 | 3.8 | 18.4 | 0 | 5 |
| Comparative Example 5 | 4.1 | 21.0 | 3.2 | 1.69 | 0.002 | 1.79 | 0.007 | 3.8 | 18.4 | 0 | 4 |
| Comparative Example 6 | 5.1 | 20.0 | 4.1 | 1.62 | 0.002 | 1.71 | 0.006 | 3.8 | 18.5 | 0 | 5 |
| Comparative Example 7 | 7.3 | 22.0 | 5.7 | 1.51 | 0.002 | 1.58 | 0.004 | 3.4 | 18.6 | 0 | 4 |
| Comparative Example 8 | 9.9 | 23.0 | 7.6 | 1.43 | 0.002 | 1.49 | 0.003 | 3.4 | 18.8 | 0 | 8 |
| Comparative Example 9 | 12.2 | 24.0 | 9.3 | 1.39 | 0.001 | 1.44 | 0.003 | 3.3 | 19.0 | 0 | 6 |
| Example 3 | 2.4 | 32.6 | 1.6 | 2.45 | 0.004 | 2.54 | 0.013 | 4.1 | 18.3 | 0 | 0 |
| Example 4 | 3.5 | 52.8 | 1.6 | 2.51 | 0.005 | 2.60 | 0.010 | 4.1 | 18.3 | 0 | 0 |
| Example 5 | 4.6 | 65.7 | 1.6 | 2.48 | 0.005 | 2.55 | 0.010 | 4.1 | 18.3 | 0 | 0 |
| Comparative Example 10 | 5.8 | 74.6 | 1.5 | 2.29 | 0.003 | 2.39 | 0.009 | 4.0 | 18.4 | 4 | 0 |
| Example 8 | 4.0 | 26.1 | 3.0 | 1.90 | 0.003 | 2.03 | 0.010 | 3.9 | 18.3 | 0 | 0 |
| Example 9 | 4.0 | 26.0 | 3.0 | 2.00 | 0.003 | 2.14 | 0.010 | 3.9 | 18.3 | 0 | 0 |
| Example 10 | 3.2 | 28.6 | 2.3 | 1.83 | 0.003 | 1.96 | 0.009 | 3.9 | 18.4 | 0 | 0 |
| Example 11 | 3.5 | 33.2 | 2.3 | 1.93 | 0.003 | 2.06 | 0.010 | 3.9 | 18.4 | 0 | 0 |
| Example 12 | 3.8 | 34.4 | 2.5 | 2.02 | 0.003 | 2.16 | 0.010 | 3.9 | 18.3 | 0 | 0 |
| Example 13 | 3.8 | 34.4 | 2.5 | 1.93 | 0.003 | 2.05 | 0.009 | 3.9 | 18.4 | 0 | 0 |
| Example 14 | 4.2 | 32.8 | 2.8 | 1.82 | 0.003 | 1.95 | 0.009 | 3.9 | 18.4 | 0 | 0 |
| Example 15 | 4.7 | 50.5 | 2.3 | 1.91 | 0.003 | 2.04 | 0.009 | 3.9 | 18.5 | 0 | 0 |
| Example 16 | 4.3 | 51.6 | 2.1 | 1.85 | 0.003 | 1.98 | 0.009 | 3.9 | 18.4 | 0 | 0 |
| Example 17 | 5.1 | 67.8 | 1.6 | 1.88 | 0.003 | 2.01 | 0.008 | 3.9 | 18.5 | 0 | 0 |
| Example 18 | 4.4 | 68.3 | 1.4 | 1.84 | 0.003 | 1.97 | 0.008 | 3.9 | 18.4 | 0 | 0 |
| Comparative Example 11 | 4.8 | 81.2 | 0.9 | 1.79 | 0.003 | 1.91 | 0.007 | 3.8 | 18.4 | 4 | 0 |
| Example 19 | 4.5 | 24.7 | 3.4 | 1.74 | 0.002 | 1.85 | 0.007 | 3.8 | 18.5 | 0 | 0 |
| Example 20 | 5.4 | 36.9 | 3.4 | 1.74 | 0.002 | 1.84 | 0.007 | 3.8 | 18.4 | 0 | 0 |
| Example 21 | 5.8 | 51.8 | 2.8 | 1.73 | 0.002 | 1.83 | 0.006 | 3.8 | 18.5 | 0 | 0 |
| Comparative Example 12 | 6.5 | 65.0 | 2.4 | 1.69 | 0.002 | 1.79 | 0.006 | 3.8 | 18.5 | 3 | 0 |
| Example 22 | 8.6 | 27.4 | 6.2 | 1.53 | 0.002 | 1.61 | 0.004 | 3.8 | 18.6 | 0 | 0 |
| Comparative Example 13 | 8.8 | 38.0 | 5.7 | 1.50 | 0.002 | 1.57 | 0.004 | 3.4 | 18.8 | 2 | 0 |
| Comparative Example 14 | 3.2 | 24.0 | 2.4 | 2.23 | 0.005 | 2.41 | 0.010 | 4.0 | 18.3 | 0 | 4 |
| Comparative Example 15 | 5.2 | 24.0 | 4.0 | 1.93 | 0.004 | 2.07 | 0.008 | 3.9 | 18.4 | 0 | 4 |
| Comparative Example 16 | 3.0 | 30.1 | 2.3 | 2.32 | 0.017 | 2.51 | 0.026 | 4.1 | 17.8 | 0 | 0 |
| Comparative Example 17 | 5.3 | 22.0 | 5.1 | 1.99 | 0.013 | 2.14 | 0.019 | 3.9 | 17.9 | 0 | 6 |
| Example 23 | 3.4 | 30.1 | 3.1 | 2.53 | 0.005 | 2.74 | 0.010 | 4.2 | 18.3 | 0 | 0 |
| Comparative Example 18 | 4.2 | 36.2 | 3.8 | 2.44 | 0.017 | 2.70 | 0.025 | 4.1 | 17.9 | 0 | 0 |
| Comparative Example 19 | 2.1 | 20.0 | 1.7 | 2.17 | 0.006 | 2.34 | 0.011 | 4.0 | 18.3 | 0 | 1 |
| Comparative Example 20 | 4.9 | 24.2 | 3.7 | 1.87 | 0.003 | 2.00 | 0.007 | 3.9 | 18.4 | 0 | 4 |
| Example 24 | 3.5 | 36.0 | 2.2 | 2.45 | 0.005 | 2.65 | 0.010 | 4.1 | 18.3 | 0 | 0 |
| Comparative Example 21 | 2.5 | 22.2 | 1.9 | 2.10 | 0.005 | 2.25 | 0.010 | 4.0 | 18.3 | 0 | 2 |
| Comparative Example 22 | 5.2 | 24.0 | 4.0 | 1.82 | 0.004 | 1.97 | 0.009 | 3.9 | 18.4 | 0 | 4 |
| Example 25 | 3.9 | 38.2 | 2.4 | 2.38 | 0.005 | 2.63 | 0.012 | 4.1 | 18.3 | 0 | 0 |
| Comparative Example 23 | — | — | — | — | — | 1.00 | 0.000 | 3.3 | 20.1 | 0 | 0 |

Example 1 and Comparative Examples 1 and 2 correspond to composite magnetic materials whose powder contains only iron. According to Table 1 and Table 2, Example 1 having the average minor axis length of 100 nm or less and falling within a predetermined area on the XY coordinate plane when $X=\sigma/A_v$ (%) and $Y=A_v-\sigma$ had an excellent property. On the other hand, Comparative Example 1 and Comparative Example 2, which are outside the predetermined area on the XY coordinate plane when $X=\sigma/A_v$ (%) and $Y=A_v-\sigma$, caused peeling in the adhesion test. Furthermore, even when the inductor component 101 was fabricated, peeling occurred in Comparative Example 1 and Comparative Example 2.

Examples 3 to 22 and Comparative Examples 3 to 13 correspond to composite magnetic materials in which the powder is an alloy of iron and cobalt. According to Table 1 and Table 2, Examples 3 to 22 having the average minor axis length of 100 nm or less and falling within the predetermined area on the XY coordinate plane when $X=\sigma/A_v$ (%) and $Y=A_v-\sigma$ had an excellent property. On the other hand, Comparative Examples 3 to 6, which are outside the predetermined area on the XY coordinate plane when $X=\sigma/A_v$ (%) and $Y=A_v-\sigma$, caused peeling in the adhesion test. In Comparative Examples 7 to 9, the relative permeability μr was poor. Furthermore, even when the inductor component 101 was fabricated, peeling occurred in Comparative Examples 3 to 9. Further, in Comparative Examples 7 to 9, L of the inductor component 101 was low. In Comparative Examples 10 to 13, cracking occurred in the adhesion test. Further, even when the inductor component 101 was fabricated, cracking occurred in Comparative Examples 10 to 13. In Comparative Example 13, L of the inductor component 101 was low.

Example 23 is an example in which the powder is an alloy of iron and cobalt and the average minor axis length is larger than that of other examples and which falls within the predetermined area on the XY coordinate plane when $X=\sigma/A_v$ (%) and $Y=A_v-\sigma$. In addition, Comparative Examples 14 and 15 have the same average minor axis length as that of Example 23, and correspond to comparative examples outside the predetermined area on the XY coordinate plane when $X=\sigma/A_v$ (%) and $Y=A_v-\sigma$. Comparative Examples 16 and 17 have the average minor axis length exceeding 100 nm, and correspond to comparative examples outside the predetermined area on the XY coordinate plane when $X=\sigma/A_v$ (%) and $Y=A_v-\sigma$. Comparative Example 18 falls within the predetermined area on the XY coordinate plane when $X=\sigma/A_v$ (%) and $Y=A_v-\sigma$ and corresponds to a comparative example having the average minor axis length exceeding 100 nm.

Example 23 exhibited an excellent property. On the other hand, in Comparative Examples 14 and 15, peeling occurred in the adhesion test. In Comparative Examples 16 to 18, the magnetic loss tan δ was significantly large. Further, when the inductor component 101 was fabricated, peeling occurred in Comparative Examples 14 to 17. Further, in Comparative Examples 16 to 18, Q of the inductor component 101 was low.

Examples 24 and 25 correspond to examples in which the powder is an alloy of iron and cobalt and the average minor axis length is a length between the lengths of Examples 1 to 22 and the length of Example 23 and which fall within the predetermined area on the XY coordinate plane when $X=\sigma/A_v$ (%) and $Y=A_v-\sigma$. In addition, Comparative Examples 19 and 20 have the same average minor axis length as that of Example 24, and correspond to comparative examples outside the predetermined area on the XY coordinate plane when $X=\sigma/A_v$ (%) and $Y=A_v-\sigma$. Comparative Examples 21 and 22 have the same average minor axis length as that of Example 25, and correspond to comparative examples outside the predetermined area on the XY coordinate plane when $X=\sigma/A_v$ (%) and $Y=A_v-\sigma$.

Examples 24 and 25 exhibited excellent properties. On the other hand, in Comparative Examples 19 to 22, when the inductor component 101 was fabricated, peeling occurred.

In Comparative Example 23, the inductor component 101 was fabricated without the composite magnetic body 105. Naturally, cracking and peeling did not occur in the inductor component 101. However, L of the inductor component 101 was low. In a column of 3.5 GHz of Table 2, the relative permeability of vacuum 1.00 and the magnetic loss of vacuum 0.000 are described for reference.

DESCRIPTION OF THE REFERENCE NUMERAL

1 powder
1*a* ellipse (circumscribing powder)
101 inductor component
103 resin
105 composite magnetic body
107 substrate
109 coil conductor

What is claimed is:

1. A composite magnetic material comprising
a powder and a resin,
wherein the powder has a main component containing Fe or Fe and Co,
an average minor axis length in primary particles of the powder is 18.6 nm or more and 94 nm or less, and
a point satisfying $(X, Y)=(\sigma/A_v\ (\%), (A_v-\sigma))$ on an XY coordinate plane is present within a region (including a boundary) surrounded by seven points (24.7, 3.4), (27.4, 6.2), (67.8, 1.6), (68.3, 1.4), (32.6, 1.6), (28.6, 2.3), and (26.0, 3.0),
in which an average of aspect ratios in the primary particles of the powder is set to $A_v$, and a standard deviation of the aspect ratios in the primary particles of the powder is set to σ.

2. The composite magnetic material according to claim 1, wherein a content ratio of Co to the main component is greater than 0 and up to and including 40 atom % in the powder.

3. The composite magnetic material according to claim 1, wherein the powder is a mixture of two powders, the two powders differing in average of aspect ratios in primary particles.

4. The composite magnetic material according to claim 3, wherein the powders additionally differ in at least one of composition of main component or average minor axis length in primary particles.

5. The composite magnetic material according to claim 3, wherein the volume ratio of the powder having the higher average of aspect ratios in the primary particles to the powder having the lower average of aspect ratios in the primary particles ranges from 10:90 to 60:40.

6. The composite magnetic material according to claim 1, wherein the Co content with respect to the total content of the main components Fe and Co is 20 to 40 atom %.

7. The composite magnetic material according to claim 1, wherein the powder is coated with an oxide layer.

8. The composite magnetic material according to claim 7, wherein the oxide layer contains one or more nonmagnetic metals selected from Mg, Ca, Sr, Ba, rare earth elements, Ti, Zr, Hf, Nb, Ta, Zn, Al, Ga and Si.

9. The composite magnetic material according to claim 7, wherein the oxide layer has a thickness of 1.0 nm or more and 10.0 nm or less.

10. The composite magnetic material according to claim 9, wherein the thickness is 1.0 nm or more and 5.0 nm or less.

11. A magnetic core comprising the composite magnetic material according to claim 1.

12. The magnetic core according to claim 11, which has a volume occupation of the powder to the entire magnetic core of 25 vol % or more.

13. An electronic component comprising the composite magnetic material according to claim 1.

* * * * *